United States Patent [19]

Bisping et al.

[11] Patent Number: 4,638,738

[45] Date of Patent: Jan. 27, 1987

[54] FIN STABILIZED SUBCALIBER SHELL OF LARGE LENGTH TO DIAMETER RATIO

[75] Inventors: Bernhard Bisping, Ratingen; Klaus Bornefeld, Duesseldorf, both of Fed. Rep. of Germany

[73] Assignee: Rheinmetall GmbH., Duesseldorf, Fed. Rep. of Germany

[21] Appl. No.: 666,181

[22] Filed: Oct. 29, 1984

[30] Foreign Application Priority Data

Oct. 28, 1983 [DE] Fed. Rep. of Germany ..... 3339078

[51] Int. Cl.[4] ..... F42B 11/08

[52] U.S. Cl. ..... 102/516; 102/517

[58] Field of Search ..... 102/514–523

[56] References Cited

U.S. PATENT DOCUMENTS

| | | | |
|---|---|---|---|
| 3,599,573 | 8/1971 | Sliney | 102/517 |
| 4,108,072 | 8/1978 | Trinks et al. | 102/518 |
| 4,353,305 | 10/1982 | Moreau et al. | 102/519 |
| 4,372,217 | 2/1983 | Kirkendall et al. | 102/521 |

FOREIGN PATENT DOCUMENTS

| | | | |
|---|---|---|---|
| 51375 | 5/1982 | European Pat. Off. | 102/519 |
| 73385 | 3/1983 | European Pat. Off. | 102/519 |

*Primary Examiner*—Harold J. Tudor

[57] ABSTRACT

In a spin stabilized flight shell, a front body and a rear body are attached to each other at a first joint, and a pointed body is attached to the front body at a second joint. The materials of the front and rear bodies contain a high proportion of at least one metallic element having a density of at least 18 g/cm$^3$. The rear body has higher ductility than the front body, which in turn is more brittle, so that it fragments easily.

In one embodiment, a case can be used to protect the first joint and the front body prior to impact. The case is developed in a circumferential region as a form locking zone, for interaction with a drive cage. The front and rear bodies and the case 38 are connected at a contact zone, for example by brazing, and is of circular cylindrical shape with a diameter equal to that of the front and rear bodies. At the rear, the case is developed into a support for the stabilizing fin assembly, and is provided with a internal compartment for a tracer composition.

In another embodiment, a drive cage with front and rear extension supports is provided, and the front and rear bodies are additionally connected to each other by a central pin.

12 Claims, 3 Drawing Figures

FIN STABILIZED SUBCALIBER SHELL OF LARGE LENGTH TO DIAMETER RATIO

The present invention relates to a fin stabilized subcaliber shell having a large length to diameter ratio, and represents an improvement over applicants' copending application, Ser. No. 552,271. The shell is suitable for automatic barrel guns used to combat both flying targets (with decreased flight time or increased fighting distance) and ground targets (such as armored tanks). The advantageous result is a multipurpose shell having a favorable ratio between its fragmentation and momentum effects.

BACKGROUND OF THE INVENTION

Spin stabilized shells with bodies of differing brittleness are disclosed in European Patent Application Publication Nos. 0051375 and 0073385. In comparison with known shells, the larger length to diameter ratio and spin stabilization of the invention results in a smaller decrease in the speed during the flight path of the shell. A shorter flight time is achieved, the probability of a hit is increased, and the fighting distance is increased.

The present spin stabilized shells also achieve an increased ballistic coefficient over those known in the art, a feature which favors the armor-piercing effect of the projectile.

The invention is explained in greater detail with reference to the two preferred embodiments shown in the drawings.

SUMMARY OF THE INVENTION

Figure 1:
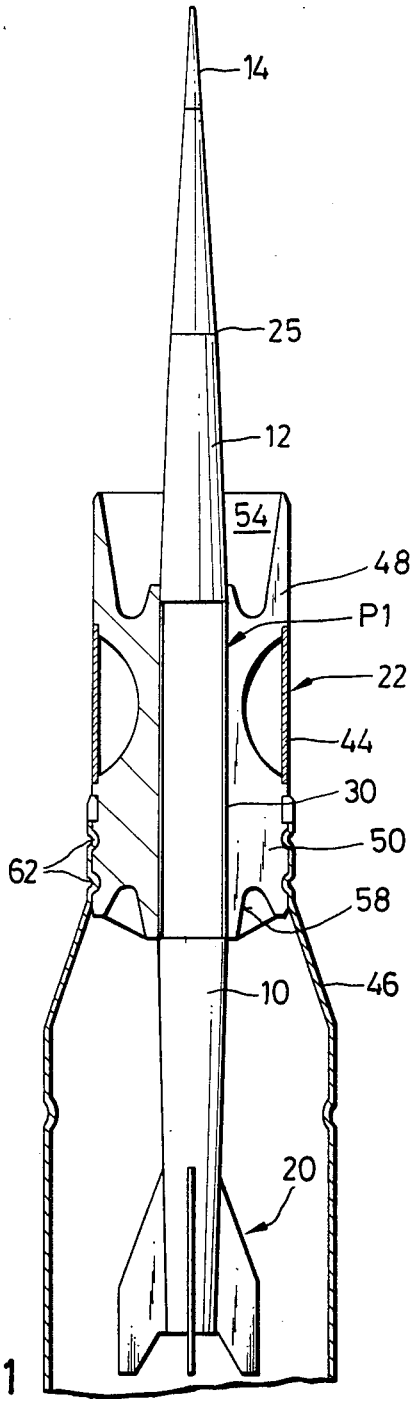
FIG. 1 shows a first embodiment having a flight shell surrounded by a drive cage, seen in lateral elevation, with a propellant-charge case shown in partial section.

Referring to FIG. 1, a first flight shell P1 is surrounded on its circumference within a form-locking zone 30 by a drive cage 22. The flight shell P1 has a stabilizing tail assembly 20 on a rear body 10. Adjoining the rear body 10 is a front body 12, which in turn adjoins pointed body 14 at the front of the shell. The drive cage 22 has a front part 48 with and air pocket 54, and a rear part 50 with a gas-pressure receiving surface 58. A propellant-charge case 46 is connected to drive cage 22 by twist grooves 62.

The front part 48 and the rear part 50 are connected smoothly to each other by a cover 44. The cover is provided with intended breakage points that are parallel to the longitudinal axis (not shown). See also FIG. 3 and the accompanying text.

Figure 2:
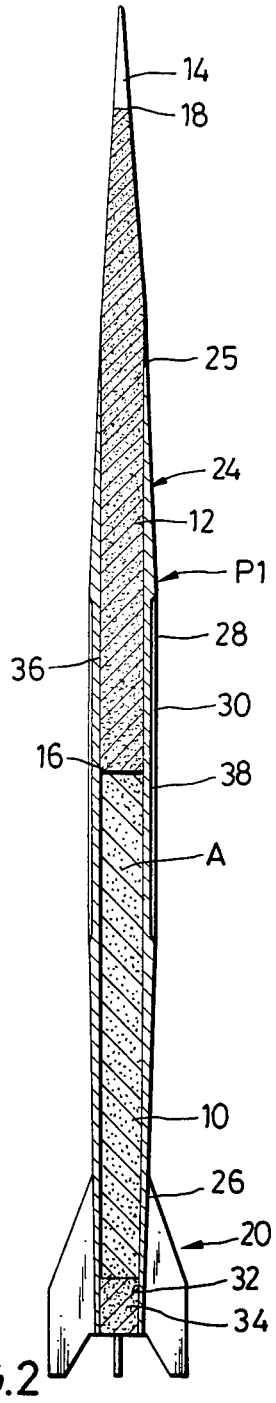
FIG. 2 shows the flight shell of FIG. 1 in a longitudinal axial section.

Turning now to FIG. 2, the flight shell P1 has an extremely strong case 38, made for example of steel. The case extends from the rear of the shell up to a front edge 25, which is developed in the shape of a knife edge. The wall thickness of the case continuously decreases within the forward thinning region 24. In its circumferential region 28, the case is provided with form locking-means (not shown) in order to create the form-locking zone 30. The zone 30 extends toward the front and rear of the shell beyond a first joint 16, within which the front and rear bodies 12 and 10 are connected to each other, as by brazing.

The inside of the case 38 is developed in the shape of a circular cylinder of constant diameter, for receiving the bodies 10 and 12. The bodies 10 and 12 and the case 38 are connected at a contact zone 36, for example by brazing. Within a rear thinning region 26, the wall thickness of the case 38 continuously decreases toward the rear, where its circumference is developed to support the stabilizing fin assembly 20. Internally, the case 38 terminates at the rear in a compartment 32, adapted to receive a tracer component 34.

The materials of the bodies 10 and 12 contain a high proportion of at least one metallic element having a density of at least 18 g/cm$^3$. The material is preferably chosen from the group consisting of depleted uranium or tungsten. For tungsten, at least 90% (by weight) of tungsten is present in a binder phase in the form of an alloy containing at least iron and nickel. The ductility of the material is therefore predetermined. Depending on the tungsten content, the material of front body 12 is rendered less ductile and more brittle, with improved fragmentation. As a result, numerous fragments of front body 12 are formed upon impact of the shell with the target.

The case 38, when the shell is used in a machine gun, absorbs transverse and longitudinal forces which might damage front body 12 and its connection to rear body 10 at first joint 16. Thus, the case protects the shell from damage during transport, handling, loading, feeding by belt, and launching.

Figure 3:
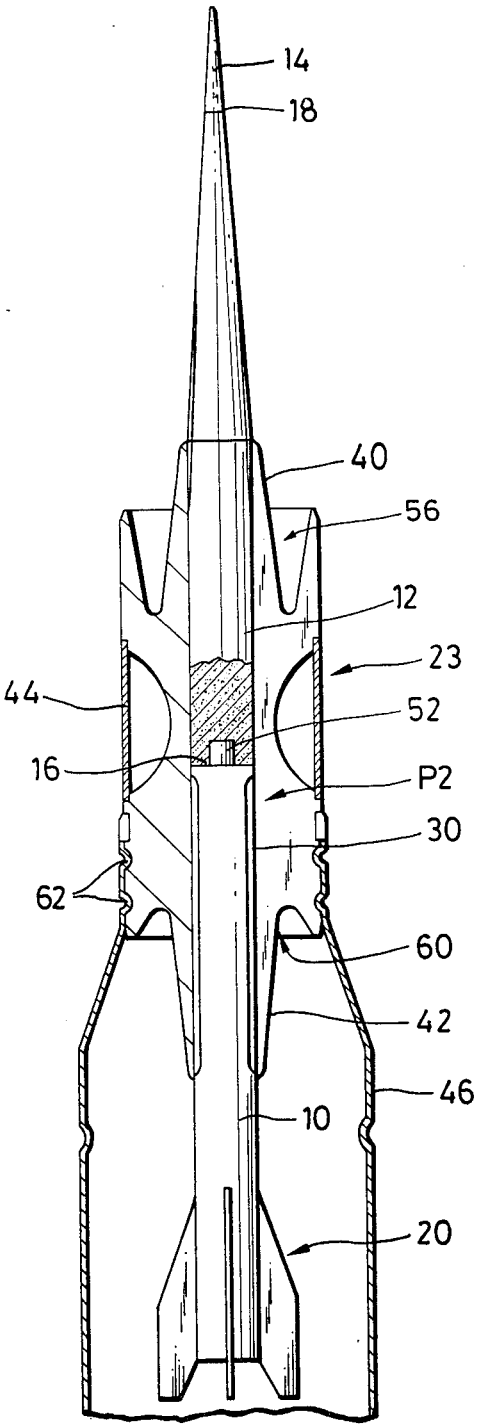
FIG. 3 shows a second embodiment, in a view similar to that in FIG. 1, with a portion of the flight shell broken away for greater clarity.

In the embodiment of FIG. 3, flight shell P2 is enclosed by a drive cage 23, instead of the case 38 of FIGS. 1 and 2, and the drive cage bears the transverse and longitudinal forces. The drive cage 23 is provided with front and rear support extensions, 40 and 42 respectively. The form locking means 30 is limited to the rear body 10 in this embodiment. At first joint 16, the front and rear bodies 12 and 10 are additionally and centrally connected to each other by a pin 52.

The support extension 40 is surrounded on the outside by an air pocket 56 and the support extension 42 is limited on the outside by a gas pressure receiving surface 60. Upon firing, the gas pressure exerts a force that is advantageously exploited to press the support extension radially against the flight shell P2.

The cover 44 is provided with places of intended breakage which are parallel to the longitudinal axis (not shown). The cover also imparts a smooth circumferential surface to the drive cage 22, 23 in both embodiments, which facilitates transport and feeding.

The flight shells P1 and P2 do not differ in target action based on the material of front body 12. However, the mass of brittle material that fragments into numerous pieces of differing size on impact with the target is greater in P2 (Figure than 3) than P1 (FIGS. 1 and 2). This difference is related to the volume of case 38, in shell P1. On the other hand, the case 38 contributes to the damage inflicted, even though less fragments are produced and driven into the target. The case is torn apart in the manner of a banana peel, starting from the front edge 25, thereby liberating more of the brittle material of front body 12. In addition, the torn case 38 is driven further into the target on impact by the inertia of rear body 10. In this manner, thin target plates, such as those made from customary light metal alloys, are penetrated over a wide area. Finally, rear body 10 penetrates deeper into the target after the initial impact and fragmentation of front body 12.

Pointed body 14 is the first to impinge on the target, and is preferably pyrophoric. Front body 12 then fragments as described. The cumulative mechanical effect on the target favors large area penetration. Larger fragments break apart during penetration, after the initial impact, and the increasingly large number of smaller fragments spread out in a fan shape. This results in numerous penetrations, all of which accumulate over a large target area and target depth.

When compared with known spin stabilized shells, the shells of the invention achieve a greater in flight velocity. This provides for an increased fighting distance and an increased probability of a hit, for both flying and ground targets.

The invention is described with reference to a number of embodiments which are present purely for purposes of illustration. It will be understood by those skilled in the art that these examples do not serve to limit the scope of the invention.

We claim:

1. A fin-stabilized subcaliber armor piercing projectile having a large length to diameter ratio comprising a metallic rear body, a metallic middle body, and a pointed front nose body, all of which are operatively joined to each other;

the middle body is made of metal of high density selected from the group of depleted uranium and tungsten of at least a density of 18 gm/cm$^3$, of lower ductility but higher brittleness than the metal of the rear body in a binder phase containing iron and nickel said rear body is made of metal of high density selected from the group of tungsten and depleted uranium in a binder phase containing iron and nickel, said rear body having a density of at least 18 g/cm$^3$;

the volume of the middle body is substantially equal to the rear body;

the pointed front nose body consists of a metal of high ductility and density which has pyrophoric properties;

the rear body and middle body are joined to each other by butt surfaces and a metal sheathing surrounds said rear and middle bodies at these butt surfaces;

said sheathing extends only to about the middle of the middle body and has a front cutting edge;

said sheathing consists of steel;

said steel sheathing has means on its external periphery for connecting it to a sabot;

the rear body coaxially extends into said sheathing and fin-stabilization means are mounted on said steel sheathing; and said middle body and rear body are joined by hard welding to each other.

2. A fin stabilized subcaliber shell as in claim 1, wherein at least one protecting means surrounds the projectile circumferentially within a region extending away from the first joint towards the front and rear of the shell.

3. A fin stabilized subcaliber shell as in claim 2, wherein at least one protecting means is a segmented drive cage.

4. A fin stabilized subcaliber shell as in claim 2, wherein at least one protecting means is said sheathing having a form locking means for cooperation with another protecting means comprising a drive cage.

5. A fin stabilized subcaliber shell as in claim 4, wherein the sheathing is adapted at least in part to support the stabilizer fin assembly.

6. A fin stabilized subcaliber shell as in claim 5, wherein the wall thickness of the sheathing decreases over a front region down to a front edge having a knife-edge shape.

7. A fin stabilized subcaliber shell as in claim 1, wherein the case is attached to the front and rear bodies by brazing at the first joint and over a contact zone.

8. A fin stabilized subcaliber shell as in claim 7, wherein the rear of the sheathing is adapted to receive a tracer composition.

9. A fin stabilized subcaliber shell as in claim 8, wherein the pointed body comprises a pyrophoric material.

10. A fin stabilized subcaliber shell as in claim 8, wherein the drive cage has front and rear parts; and the shell additionally comprises a cover, having intended places of breakage, located parallel to the longitudinal axis of the shell and smoothly and circumferentially connecting the front and rear parts of the drive cage.

11. A fin-stabilized subcaliber shell, as defined in claim 1, wherein said metal content of the said middle and rear bodies is at least 90 percent by weight tungsten.

12. A fin-stabilized subcaliber shell, as defined in claim 1, wherein said metal content of the said middle and rear bodies consists essentially of depleted uranium.

* * * * *